US010480850B2

(12) United States Patent
Ivanovic et al.

(10) Patent No.: US 10,480,850 B2
(45) Date of Patent: Nov. 19, 2019

(54) DOOR AND HOUSEHOLD APPLIANCE COMPRISING A DOOR

(71) Applicant: ELECTROLUX APPLIANCES AKTIEBOLAG, Stockholm (SE)

(72) Inventors: Branko Ivanovic, Rothenburg ob der Tauber (DE); Rudolf Schmidt, Rothenburg ob der Tauber (DE); Dietmar Hildner, Rothenburg ob der Tauber (DE); Christoph Luckhardt, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/567,643

(22) PCT Filed: May 12, 2016

(86) PCT No.: PCT/EP2016/060716
§ 371 (c)(1),
(2) Date: Oct. 19, 2017

(87) PCT Pub. No.: WO2016/188765
PCT Pub. Date: Dec. 1, 2016

(65) Prior Publication Data

US 2018/0112911 A1 Apr. 26, 2018

(30) Foreign Application Priority Data

May 26, 2015 (EP) ..... 15169120

(51) Int. Cl.
*F25D 27/00* (2006.01)
*F24C 7/08* (2006.01)
(Continued)

(52) U.S. Cl.
CPC ..... *F25D 27/005* (2013.01); *F24C 7/085* (2013.01); *F24C 15/008* (2013.01); *F24C 15/02* (2013.01);
(Continued)

(58) Field of Classification Search
CPC .... F25D 27/005; F25D 23/02; F25D 2400/22; F25D 2400/40; F24C 15/028; F24C 15/008; F24C 7/085; F24C 15/02
(Continued)

(56) References Cited

U.S. PATENT DOCUMENTS 4,194,193 A * 3/1980 McDonough ..... G08B 13/08 200/61.62
4,691,195 A * 9/1987 Sigelman ..... F25D 29/008 200/61.62
(Continued)

FOREIGN PATENT DOCUMENTS

DE 3643354 6/1988
DE 10341330 3/2005
(Continued)

OTHER PUBLICATIONS

International Search Report and Written Opinion for PCT/EP2016/060716, dated Jul. 19, 2016, 10 pages.

*Primary Examiner* — Ahmed M Saeed
*Assistant Examiner* — Lheiren Mae A Caroc
(74) *Attorney, Agent, or Firm* — Pearne & Gordon LLP

(57) ABSTRACT

The invention relates to a door for closing a cavity (3) included in a chassis (2) of a household or kitchen appliance (1), the door (10) comprising a first electrical component that can be releasably electrically coupled with a second electrical component comprised within the chassis (3) of the household or kitchen appliance (2) in the closed state of the door (10) by first coupling means (20), said first coupling
(Continued)

means (20) comprising a first contact section (21) arranged at the door (10) for releasable interaction with corresponding second contact section (22) arranged at said chassis (3), wherein said first contact section is configured such that in the closed state of the door (10) an electrical contact is established between said first and second contact sections (21, 22) and said electrical contact is opened when opening the door (10), wherein the first contact section (21) is arranged at a removable door portion (11) and the door (10) comprises second coupling means (30) are provided for releasable electrical coupling of the first contact section (21) with the first electrical component.

16 Claims, 6 Drawing Sheets

(51) Int. Cl.
*F24C 15/00* (2006.01)
*F24C 15/02* (2006.01)
*F25D 23/02* (2006.01)

(52) U.S. Cl.
CPC ..... *F24C 15/028* (2013.01); *F25D 23/02* (2013.01); *F25D 2400/22* (2013.01); *F25D 2400/40* (2013.01)

(58) Field of Classification Search
USPC ..... 200/61.58 R, 61.62
See application file for complete search history.

(56) References Cited

U.S. PATENT DOCUMENTS

| | | | | |
|---|---|---|---|---|
| 8,314,354 | B2 * | 11/2012 | Prest | H01H 13/7057 200/406 |
| 9,829,201 | B2 * | 11/2017 | Boedicker | F24C 15/322 |
| 2004/0240196 | A1 | 12/2004 | Wilsdorf et al. | |
| 2009/0039068 | A1 | 2/2009 | Boutwell | |

FOREIGN PATENT DOCUMENTS

| | | |
|---|---|---|
| DE | 102005045367 | 3/2007 |
| DE | 102007015237 | 10/2008 |
| DE | 102007057767 | 6/2009 |
| DE | 102013105114 | 11/2014 |
| EP | 2821711 | 1/2015 |
| JP | 2014145564 | 8/2014 |

* cited by examiner

DOOR AND HOUSEHOLD APPLIANCE COMPRISING A DOOR

Generally, the present invention relates to the field of household appliances. More specifically, the present invention relates to a door of a household appliance comprising an electrical component and coupling means for providing an electrical coupling between said electrical component and a further electrical component comprised within a chassis of the household appliance.

BACKGROUND OF THE INVENTION

Household or kitchen appliances comprising a door with an electrical component are known in prior art. In order to power said electrical component, cable connections are used for providing electrical power from a power supply included in the base body or chassis of the household appliance to the electrical component included in the door. A big disadvantage of cable connections is that the door cannot be disassembled for a cleaning purpose and assembling/disassembling of such door is complicated due to cable connection. Furthermore, during door opening and closing cycle, the cable connections could be broken leading to a loss of power and/or data connection between the door and body.

German Patent Application DE 10 2007 015 237 A1 discloses a household appliance comprising an electrical contact unit for enabling an electrical connection between a supply unit included in the base body/chassis of the household appliance and lighting means included in the oven door.

SUMMARY OF THE INVENTION

It is an objective of the embodiments of the invention to provide a door for a household or kitchen appliance and a household or kitchen appliance which provides an electrical coupling between the base body/chassis of the appliance and an electrical component included in the appliance door and which can be assembled/disassembled easily. If not explicitly indicated otherwise, embodiments of the invention can be freely combined with each other.

According to an aspect of the invention, the invention relates to a door for closing a cavity included in a chassis of a household or kitchen appliance. The door comprises a first electrical component, said first electrical component being releasably electrically coupled with a second electrical component comprised within the chassis of the household or kitchen appliance by first coupling means in a closed state of the door. Said first coupling means comprise a first contact section arranged at the door. Said first contact section interacts with a corresponding second contact section arranged at the chassis, wherein said first contact section is configured such that in the closed state of the door an electrical contact is established between said first and second contact sections and said electrical contact is opened/interrupted when opening the door. The first contact section is arranged at a removable door portion and second coupling means are provided at the door for releasably electrically coupling the first contact section with the first electrical component. Said second coupling means may provide a detachable electrical connection between the first contact section and the first electrical component. It is worth mentioning that the term "releasably electrically coupled" as used in the present disclosure means that the electrical coupling can be established, respectively interrupted without using any tools, i.e. the electrical connection between the first and second contact section is established/interrupted depending on the position of the door (opened door/closed door). Specifically, "releasably electrically coupled" means that the electrical coupling can be disconnected and reconnected iteratively without using any tools, specifically by opening/closing the door and/or assembling/disassembling the removable door portion.

The main advantage of providing the first contact section at the removable door portion and coupling said first contact section with the first electrical component via second coupling means is that the door portion can be easily removed by a user without taking care about the electrical connection which is established via said removable door portion. The removable door portion may be adapted to be removed from the door without using any tools, e.g. by a manually operable quick-lock mechanism or snap mechanism. So, in other words, the removable door portion may be adapted to be detachable from the door and re-attachable at the door. The removable door portion may be a door cover element which is adapted to provide an opening at the door after removal, said opening enabling a further disassembling of door elements, e.g. one or more door glasses.

According to embodiments, the second coupling means comprise a third and a fourth contact section, said third contact section being arranged at the removable door portion and the fourth contact section being arranged at a structural element of the door. For example, the third contact section may be of pad connector type and the fourth contact section may comprise an electrical connector of spring connector type (e.g. spring loaded contact, compression connector, spiral connector etc.). Also a vice versa arrangement may be possible. Thereby, the third contact section is removed from the door when disassembling the removable door portion and the fourth contact section remains at the structural element of the door, e.g. the door frame.

According to embodiments, the third and fourth contact sections are adapted and arranged to each other such that an electrical contact is established between the third and fourth contact section when the removable door portion is assembled at the door and the electrical contact is open when the removable door portion is disassembled. In other words, the second coupling means provide a detachable, separable electrical connection which is established by assembling the removable door portion at the structural element of the door and detached by removing said door portion. Thereby, a user-friendly door for a household appliance is provided.

According to embodiments, the first electrical component comprises an electrical sensor or an electrical driven component and the second electrical component comprises a power board or a control unit of the household or kitchen appliance. Via said first and second coupling means, the transmission of electrical power as well as the transmission of electrical control information may be provided.

According to embodiments, at least one of the first and second contact sections and the third and fourth contact sections form a pair of matching contact sections that comprises an electrical connector of compression type or sliding type. In particular, the first and second contact sections comprise an electrical connector of compression type and/or the third and fourth contact sections comprise a connector of sliding type. For example, at least one contact section of the second coupling means may be a spring-loaded contact. Thereby, an improved electrical contact between the electrical contact sections is obtained because the contact sections are pressed against each other by using spring forces.

According to embodiments, the first contact section is arranged close to an upper edge of the door, specifically close to one of the two upper corners of the door. Preferably, at least one of the first and second electric component is comprised in an upper region of the door or the chassis, in particular, wherein the door is pivotally connected to the chassis of the household or kitchen appliance about a horizontal axis at its lower edge region or about a vertical axis at one of its lateral edge regions. In case of a household appliance in the form of an oven, said upper edge/upper corner region may be the coldest door portion, i.e. the heat impact to the first electrical coupling means is reduced.

According to embodiments, the first coupling means, in particular the first and second contact sections comprise at least one connector of compression type, namely a spring-loaded connector, compression connector and/or spiral connector. Said types of connectors provide a reliable electrical contact via the interface between the chassis and the door in the closed state of said door. Preferably, said first coupling means may be designed for a supply voltage up to 50V AC/DC.

According to embodiments, the one of the first and second contact sections of the first coupling means comprises a fixed electrically conductive contact area and its matching partner (the further contact section interacting with said contact section) comprises a movable, spring-loaded, electrically conductive contact area. Said fixed electrically conductive contact areas may be of pad connector type and the spring-loaded contact areas may be pressed against said fixed electrically conductive contact areas due to spring forces applied to said movable contact areas in the closed state of the door.

According to embodiments, the third and fourth contact sections of the second coupling comprise at least one connector of compression type, in particular a spring-loaded connector, a compression connector or a spiral connector.

According to embodiments, the third and fourth contact sections of the second coupling means both comprise matching fixed electrically conductive contact areas that are adapted to be brought into electrical contact by a movement, in particular by a sliding movement, when the removable door portion is assembled at the door. Thereby, a technically simple assembling of the removable door portion is possible during which a highly conductive electrical coupling between the third and fourth coupling section is obtained.

According to embodiments, the door comprises at least one inner glass pane, said inner glass pane being removably mounted at/or within the door, wherein the inner glass pane comprises an upper edge which may be covered by said removable door portion in the mounted state of the inner glass pane. In other words, the removable door portion is detachable for disassembling the inner glass pane. Thereby, a technically simple disassembling of said inner glass pane, e.g. for cleaning purposes, is obtained.

According to embodiments, the removable door portion is arranged at the upper edge of the door. In particular, the removable door portion may be arranged adjacent to or on an upper edge of a front glass pane of the door. Said position is advantageous because the glass pane can be pulled out upwardly.

According to embodiments, the removable door portion may encompass the one or more glass panes at least at an upper edge in the assembled state. Thereby, the one or more glass panes are secured against movements by means of said removable door portion.

According to embodiments, the door comprises a front glass pane, two door columns fixed at opposite sides in the lateral regions of the front glass pane on the cavity-facing side thereof and at least one inner glass pane that can be attached to the two door columns, wherein the removable door portion is removably connected, in particular completely removably connected to the two door columns. Due to the detachable second electrical coupling means, the door portion can be completely removed without any remaining cable connections between the door and the removable door element.

According to embodiments, the first and/or second coupling means comprise at least one plunger and at least one contact sleeve providing a cavity for receiving the plunger, wherein the plunger comprises a conical or tapered free end which is received in the cavity of the contact sleeve. Thereby, the electrical contact between the electrical contact sections is enhanced.

According to other embodiments, the first and/or second coupling means comprise at least one plunger and at least one contact strip.

According to embodiments, the plunger is spring-loaded. Thus, the plunger is pressed into the cavity of the contact sleeve by means of said spring forces thereby further enhancing the electrical contact.

According to embodiments, at least one contact surface of the first and/or second coupling means, specifically, the contact surfaces of the first, second, third and fourth contact sections are plated by a highly conductive material, e.g. gold (AU), silver (Ag), copper (CU), nickel (Ni), rhodium (Rh) or platinum (Pt). Thereby, the electrical contact resistance between the electrical contact sections is reduced.

According to embodiments, the spring providing a spring-loading of the first and/or second coupling means is plated by a highly conductive material, e.g. gold (AU), silver (Ag), copper (CU), nickel (Ni), rhodium (Rh) or platinum (Pt).

According to embodiments, at least one of the contact sections is at least partially integrated in a housing, in particular in a plastic housing made of Polybutylene terephthalate (PBT), liquid crystal polymer (LCP) or Polyphthalamide (PPA) including glass fibres (HTN), wherein said housing is mounted at the chassis or the door, in particular mounted by screws or a clip mechanism.

According to a further aspect, the invention refers to an oven for preparing food comprising a chassis including a cavity and a door for closing the cavity, characterized in that the door is configured according to any of the foregoing embodiments.

The terms "essentially", "substantially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
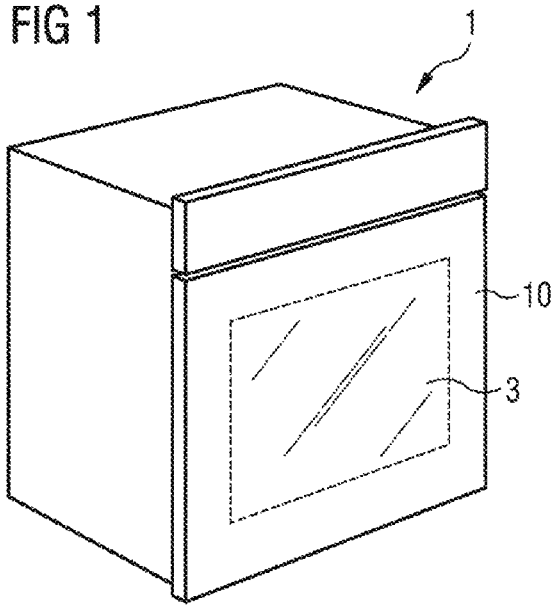
FIG. 1 shows an example schematic view of a baking oven.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic diagram of a household or kitchen appliance 1, according to the present embodiment constituted by a baking oven. The household or kitchen appliance 1 comprises a chassis 2, in the following also referred to as base body of the household or kitchen appliance 1. The chassis 2 comprises a cavity 3 which—in case of a baking oven—is adapted to receive the food to be cooked and/or baked. The household or kitchen appliance 1 further comprises a door 10. In case of an oven, the door 10 may be adapted to be opened in order to place the food into the cavity 2 and closed in order to obtain a closed cavity 2 for performing the cooking or baking process.

The door 10 is pivotally mounted at the chassis 2 by means of one or more hinges. For example, the door 10 may be a flip-down door, i.e. a door 10 being adapted to be pivoted about a horizontal axis at its lower edge. It is worth mentioning that also other configurations are possible, e.g. side-opening doors. Said hinges may be adapted such that the door 10 can be manually disassembled from the chassis 2 without using any tools. For example, the hinges or the door 10 itself may comprise lever portions, said lever portions being adapted to be moved or shifted in order to remove the door from the chassis 2.

Figure 2:
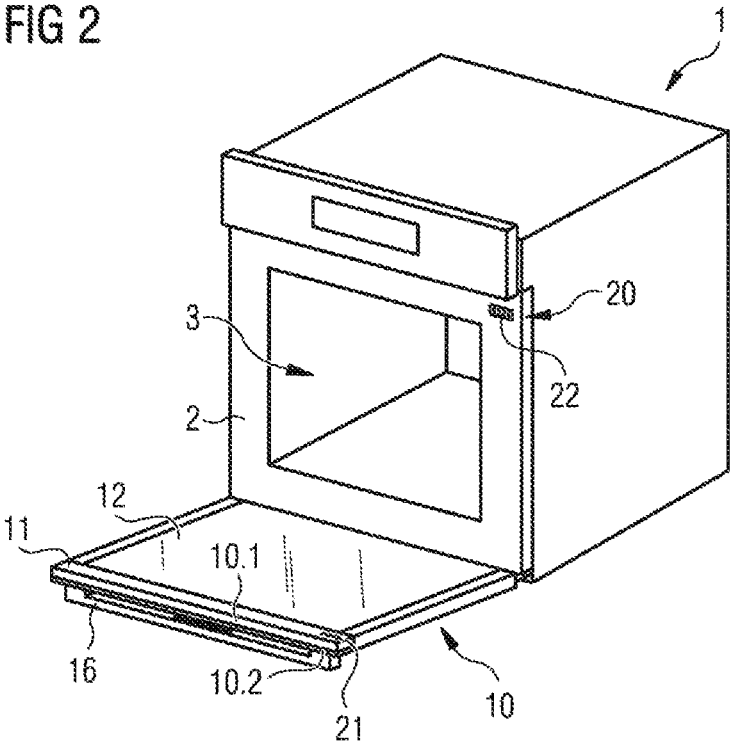
FIG. 2 shows an example schematic view of an oven with an open oven cavity.
Figure 3:
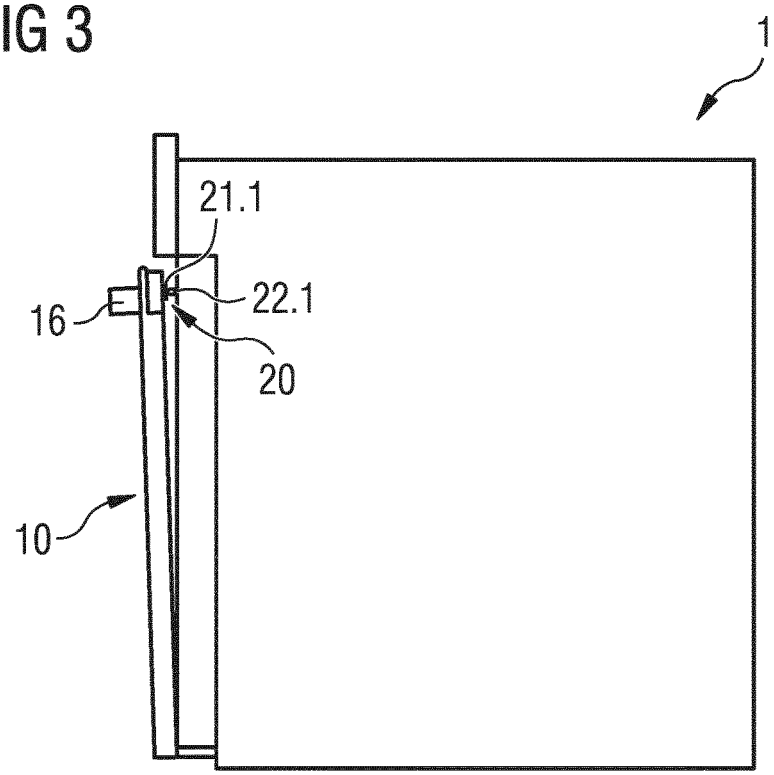
FIG. 3 shows an example schematic side view of an oven with a slightly opened door.
Figure 4:
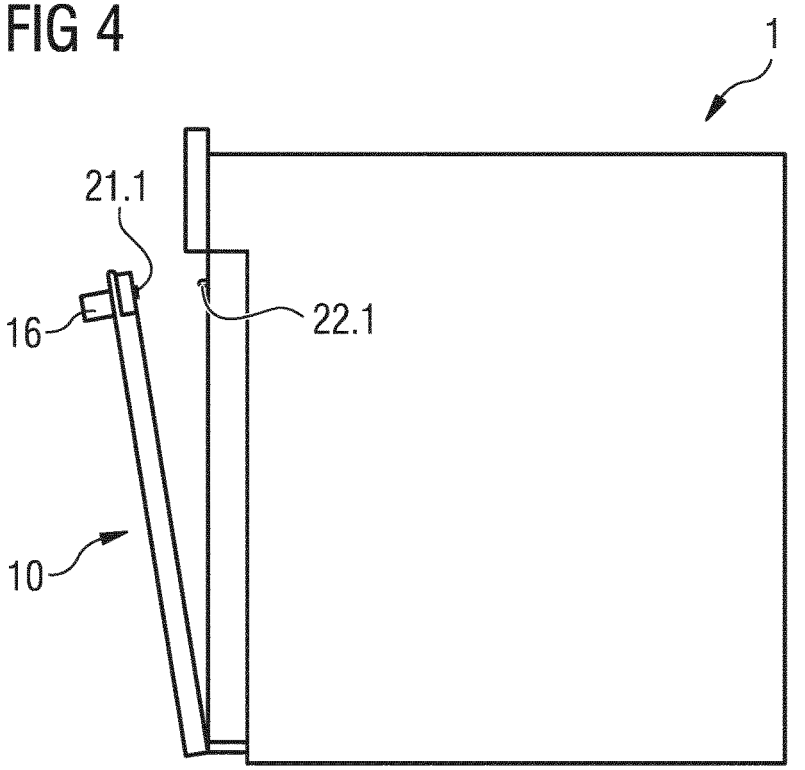
FIG. 4 shows a further example schematic side view of an oven with an opened door.

FIGS. 2 to 4 show an oven in closer detail. The door 10 comprises one or more structural elements which may ensure the mechanical stability of the door 10. Said one or more structural elements may also be used for pivotally mounting the door 10 at the chassis 2. For example, the structural elements may comprise a pair of door columns 13 which may be arranged at opposite lateral sides of the door 10. According to another embodiment, the structural element may be a door frame which at least partially borders the door 10 circumferentially. The door 10 may further comprise a glass pane 12 or glass portion which is constituted by a transparent glass in order to enable a user to look into the cavity 2 without opening the door 10. Said glass pane 12 may be an inner glass pane.

The door 10 further comprises a first electrical component (not explicitly shown in the figures). The first electrical component may be included within the door 10 or may be attached to said door 10. For example, the first electrical component may comprise lighting means for providing an optical user interface at the oven door or for illuminating the cavity 3, may be a user interface for controlling the household appliance or a display for providing information to the user of the household appliance a. In a broad sense, the first electrical component may be any electrical entity comprised at or within the door 10 which needs to be electrically coupled with a further electrical entity comprised within the chassis 2 of the household appliance 1. Said electrically coupling may be used for providing electrical power to said first electrical component or for providing control information to said first electrical component.

At or within the chassis 2 of the household appliance 1, a second electrical component may be provided (not explicitly shown in the figures). Said second electrical component may interact with the first electrical component included in the door 10. In order to enable said interaction between the first and second electrical component, an electrical connection between the first and the second electrical component is required. For example, the second electrical component may be a power supply unit being adapted to provide electrical power to the first electrical component. According to another embodiment, the second electrical component may be a control unit adapted to provide control information to the first electrical component and/or adapted to receive information from the first electrical component. In general, the second electrical component may be any entity which is adapted to interact with the first electrical component wherein an electrical connection between the first and second electrical component is required for said interaction. Said electrical connection has to be provided via the interface between the chassis 2 of the household appliance 1 and the door 10 because the first electrical component is comprised at or within the door 10 whereas the second electrical component is included in the chassis 2.

In order to establish an electrical connection between the first and the second electrical component at least in the closed state of the door 10, first coupling means 20 are provided. Said first coupling means 20 comprise a first contact section 21 and a second contact section 22. The first contact section 21 may be arranged at the door 10 and the second contact section 22 may be arranged at the chassis 2 of the household appliance 1. Preferably, the first coupling means 20 may be arranged in a region of the household appliance 1 which is close to the first and/or second electrical component which are coupled with each other via said first coupling means 20. Still preferably, the first coupling means 20 may be placed in an area, at which the heat impact to said first coupling means 20 is minimized. More in detail, the first contact section 21 may be placed at or close to the coldest area of the door 10. Therefore, the first coupling means 20 may be arranged at an upper edge 10.1 of the door 10, specifically, the first coupling means may be arranged at one of the upper corners 10.2 of the door 10. At said positions, the heat impact to the first coupling means 20 is minimized (which is specifically advantageous in case of a pyrolyse oven) and the distance between the first and a second electrical components is minimized thereby reducing the necessary wire length.

According to embodiments, the first coupling means 20 may comprise one or more spring-loaded connectors, compression connectors and/or spiral connectors. For example, the first contact section 21 comprises electrical pad connectors (i.e. said electrical pad connectors are located at the door side) whereas the second contact section 22 may comprise spring-loaded connectors (SLC) or contacts, compression connectors, spiral connectors and/or stripes. Also a vice versa arrangement is possible.

The spring-loaded connector may be, for example, a so-called POGO pin connector comprising a spring-loaded POGO pin which is adapted to perform an axial movement for establishing the electrical connection. For example, the spring-loaded POGO pin may be at least partially inserted in a sleeve when closing the door 10. For example, spring-loaded contacts (SLC) are made of a contact body or barrel, a piston and a helical compression spring. The electrical contact is established by pressuring the contact body against a fixed, in particular, flat area called pad connector.

The spring loading the POGO pin ensures a permanent pressing of the free end of the POGO pin to the corresponding second contact section 22 in order to obtain low contact resistance. Said spring-loaded pin may interact with a pad contact or a contact element comprising a cavity for receiving said pin for establishing the electrical connection.

For example, the following types of SLCs might be used:

- flat type (single or multiple) which means that the SLC can be directly connected to a wiring, e.g. by means of soldering;
- plug-in type, i.e. a wiring can be directly plugged into the rear end of the SLC or directly connected, for example, by means of a crimp contact;
- double-ended type;
- right-angle type.

SLCs provide a plurality of advantages, for example:

- very long life time;
- usage of different spring forces are possible. For example, spring forces in the range from 0.1N to 20N are possible. This is a big advantage because when using SLCs with low spring forces, there will be no negative impact on closing forces of the door, the door will stay tight and a usage of stronger hinges with higher closing is not required;
- very small dimensions (e.g. outer diameter of 1 mm and lower as well as different lengths) which enables a simple integration into the door and chassis;
- different strokes possible (e.g. in the range of 0.5 mm to 10 mm); thereby negative impacts due to tolerances (e.g. gasket thickness, distance from door to cavity etc.) can be avoided by choosing the appropriate stroke which ensures an electrical contact between the first and second contact section 21, 22 (e.g. a stroke from 2 mm to 5 mm);
- stable electrical resistance values without micro-discontinuities; there is no or essentially no contact interruption (>50 ns) even when the piston is moving or in case of vibrations;
- very low pitches possible (by multiple usage);
- very low current resistance
- operating temperature between −50° C. and +85° C. (using music wire) or between −50° C. and +250° C. (using steel wire);
- high corrosion resistance;
- moisture resistance;
- resistance to soldering heat.

In order to further improve the electrical contact for transmission of electrical power it might be possible to use multiple different free-end profiles (head profiles) at the spring-loaded connector, e.g. round, flat, sharp etc.

Alternatively or in addition, compression connectors may be used. Said compression connectors comprise a spring-like contact, for example formed by a metallic flat material which interacts with the corresponding pad connector at the opposite side. Still alternatively, spiral connectors may be used comprising a spiral-shaped contact which may be compressed in the axial direction of the spiral when being pressed against a corresponding pad connector at the opposite side for establishing the electrical contact. Also other connector types for realizing said first coupling means 20 are possible.

Figure 5:
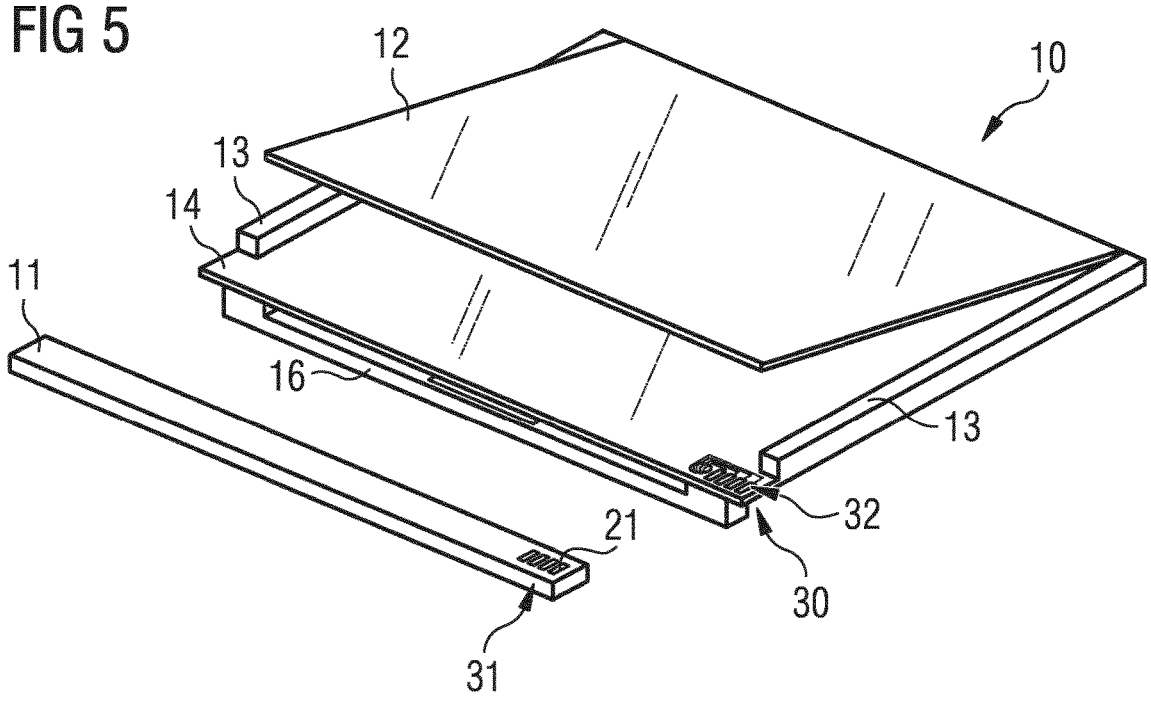
FIG. 5 shows an example schematic perspective view of an oven door with a removed door portion.
Figure 6:
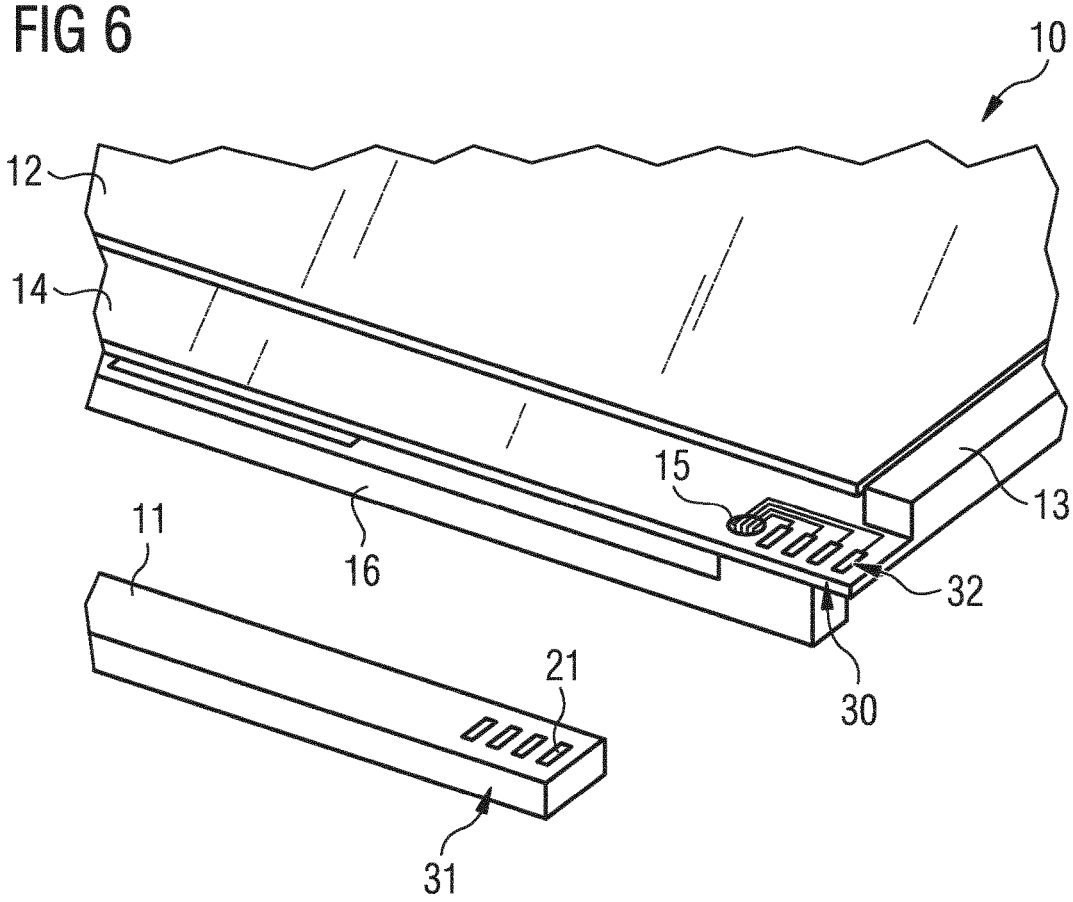
FIG. 6 shows an example schematic perspective view of the second electrical coupling means between the structural element of the oven door and the removable door portion.

As shown in FIG. 5 or 6, the door 10 comprises a removable door portion 11, for example constituted by a door cover or door cap and a fixed door portion, inter alia comprising a pair of door columns 13. The removable door portion 11 may be removably assembled at the upper edge 10.1 of the door 10. Said removable door portion 11 may be adapted such that after disassembling the removable door portion 11, the door 10 can be further disassembled. In particular, as shown in FIG. 5, the door 10 may comprise at least one glass pane 12, specifically the inner glass pane which can be removed from the door 10 in order to clean said glass pane 12.

Said door 10 is adapted to be partially disassembled, specifically manually disassembled without using any tools. For example, after removing the removable door portion 11, an opening is provided which allows a removal of an inner glass pane (in case that the door 10 comprises a double-glass pane structure) or an inner and a middle glass pane (in case that the door 10 comprises a triple-glass pane structure). As shown in FIG. 5, the door 10 may comprise a pair of door columns 13 which may be arranged at lateral edges of the front glass pane 14 and which may be non-separably (i.e. without damaging or destroying the door) mounted at said front glass pane 14. The one or more glass panes 12 are laterally supported by said door columns 13. More in detail, in order to assemble the door 10, said one or more glass panes 12 can be arranged at said door columns 13. When arranging the removable door portion 11 at the door, the one or more glass panes 12 are fixed at the door 10. Specifically, the removable door portion 11 blocks a movement of the one or more glass panes 12 towards an upper edge of the door and an undesired falling-out of the door panes 12 (in a direction towards the cavity 3 in the closed state of the door 10). Thus, the removable door portion 11 may encompass the one or more glass panes 12 at least at an upper edge.

As already mentioned above, the first coupling means 20 may be arranged at the top portion, i.e. close to the upper edge 10.1 of the door 10. Furthermore, the removable door portion 11 may be also arranged at the upper edge 10.1 of the door 10 for enabling said disassembling of the door 10. So, according to embodiments, the first contact section 21 of the first coupling means 20 may be included in said removable door portion 11. The arrangement of the first contact section 21 at the removable door portion 11 may be chosen such that said first contact section faces 21 the second contact section 22 in case that the removable door portion 11 is assembled at the door 10 and the door 10 is closed. In other words, the first and second contact section 21, 22 are interacting with each other such, that after assembling the removable door portion 11 at the door 10 and closing the door, an electrical contact between the first and second contact section 21, 22 is achieved.

In order to be able to completely remove the removable door portion 11 from the structural element of the door 10 (i.e. without any remaining cabling between the removable door portion 11 and the door 10), second coupling means 30 are provided. Said second coupling means 30 comprise a third contact section 31 and a fourth contact section 32. The third and the fourth coupling sections 31, 32 interact with each other such that in the assembled state of the removable door portion 11 a releasable electrical contact between said coupling sections 31, 32 is obtained. In other words, the third and the fourth coupling sections 31, 32 are matching partners.

More in detail, the removable door portion 11 comprises a third contact section 31 which is electrically coupled with the first contact section 21 (belonging to the first coupling means 20 establishing the electrical connection when the door 10 is closed). Said electrical coupling may be, for example, constituted by a fixed wiring. Thereby, an electrical connection between the first coupling means 20 and the second coupling means 30 is established. Furthermore, the fourth coupling section 32 may be arranged at a structural element of the door 10 (e.g. the frame, the door column 13 or a front glass pane) and may be electrically coupled with the first electrical component comprised within the door 10 by a wiring 40. So, in other words, the second coupling means 30 are adapted to provide a releasable electrical contact between the first coupling means 20 and the first electrical component comprised within the door 10. Said second coupling means 30 are configured such that in the assembled state of the removable door portion 11, an electrical connection between the first coupling means 20 and the first electrical component is provided and the electrical connection is opened when disassembling the removable door portion 11. For example, the third contact section 31 may comprise one or more pad connectors and the fourth contact section 32 may comprise one or more movable connectors (e.g. strip contacts, spring stripe contacts, springs etc.) interacting with said pad connectors. Also a vice versa configuration is possible. Said movable connectors may be spring-loaded connectors, compression connectors, strip contacts, spring stripe contacts, springs and/or spiral connectors as described above. Thereby, a customer can easy disassemble said removable door portion 11, e.g. for cleaning purposes as well as reassemble it in the reverse way thereby establishing an electrical connection via the second coupling means 30 between the first electrical component and the first coupling means 20 without any fixed-wire connection between the removable door portion 11 and the door 10. Preferably, the second coupling means 30 are chosen such that an electrical connection is realized by simply arranging the removable door portion 11 at the door base structure or door frame.

High electrical conductivity is a key criterion of electrical contacts. In order to improve the quality of the electrical contact, the first and second coupling means 20, 30 may comprise contact sections 21, 22, 31, 32 comprising at least a high-conductive coating. For example, the contact sections 21, 22, 31, 32 may be gold-plated. Gold offers at the same time excellent protection against corrosion and oxidation. However, also other coating materials can be used, e.g. Ag, Cu, Ni, Ni, Rh, Pt. In case that the first and second coupling means comprise a spring (e.g. POGO-spring connectors or spring-loaded connectors), also said spring may be gold- or silver-plated (excluding stainless steel springs). In preferred embodiments, the barrels of the spring-loaded connectors are plated twice (first with Nickel (e.g. 1-2 μm) followed by Gold (e.g. 0.1-1 μm)). The main spring may be made out music wire, stainless steel wire, Beryllium Bronze etc.

Preferred materials for pistons, barrels and clips (RoHS-compliant) could be:

Beryllium Copper, Brass Alloy, Copper Alloy, Cooper Beryllium, Nickel Alloy, Titanium Cooper, Nickel Silver, Phosphor Bronze.

Furthermore, to avoid spark erosion on contact surfaces which are very thin plated, an additional layer of e.g. Ag can be applied on it, e.g. having an additional thickness from 0.1-3 mm. Said additional layer may have a drop shape. This can be applied by means of welding-soldering, riveting etc. It can be applied directly on a plunger 22.1, 32.1 or contact strip 21.1.

In order to further enhance the electrical connection between the contact sections 21, 22, 31, 32, a first electrical contact of said contact sections 21, 22, 31, 32 may comprise a tapered or conical shape. Specifically, the free end of the first electrical contact may comprise a tapered or conical shape. For example, the first electrical contact is a plunger 22.1 (FIG. 3, 4). The corresponding second electrical contact interacting with said first electrical contact may be a contact sleeve 21.1 comprising a cavity which is adapted to receive said free end of the first electrical contact, specifically, the free end of the plunger 22.1. Due to said tapered/conical shape, a highly reliable electrical contact is realized which provides a low contact resistance. According to another embodiment, in cases of significant tolerances between the door 10 and the chassis 2, a preferred combination may be a spring loaded contact (SLC) or a spring contact on a first side (e.g. arranged at the chassis 2) and a stripe contact comprising a flat contact surface which is significantly larger than the spring loaded contact (SLC) or a spring contact at the other side (e.g. arranged at the door 10).

Due to the detachable electrical connection between the first electrical component arranged within the chassis 2 of the household appliance 1 and the door 10 based on the first coupling means 20, the door 10 can also be disassembled (e.g. taken off the studs of the door hinge) without extra disconnection of the electrical connection between the door 10 and the chassis 2. Furthermore, to avoid that the second contact section 22 is still connected to the electrical power after opening the door 10 (with the risk of short circuit during cleaning by a customer) a door switch (not shown) can be connected to the electric power line and, immediately after the said door 10 is closed, electrical power can be provided to the second contact section 22. Accordingly, immediately after opening the door, electrical power to the second contact section 22 is interrupted and a customer may be able clean to contacts without any risks of causing a short circuit. In addition, the usage of a door switch (e.g. a switch typically used for switching the light of the oven cavity) which detects whether the door is opened or closed as a switch for electrical power provision to the second contact section 22 avoids sparks formation between the first and second contact section 21, 22 which may occur through the very low contact forces, door shattering or door bouncing. Furthermore, it avoids power disconnecting because of bounce of contacts.

As shown in FIG. 6, the structural element of the door 10 may be the front-side door glass pane 14. Close to the upper edge of said front glass pane 14, the fourth contact section 32 may be provided which is interacting with a corresponding third contact section 31 arranged at the removable door portion 11. For example, the third/fourth contact section may be manufactured by means of Laser Direct Structuring (LDS) Technology which enables the combination of electronic and mechanical functions on one component. For example, a mechanically necessary component is first laser structured, then provided with strip conductors and subsequently takes an additional electronic task.

Figure 7:
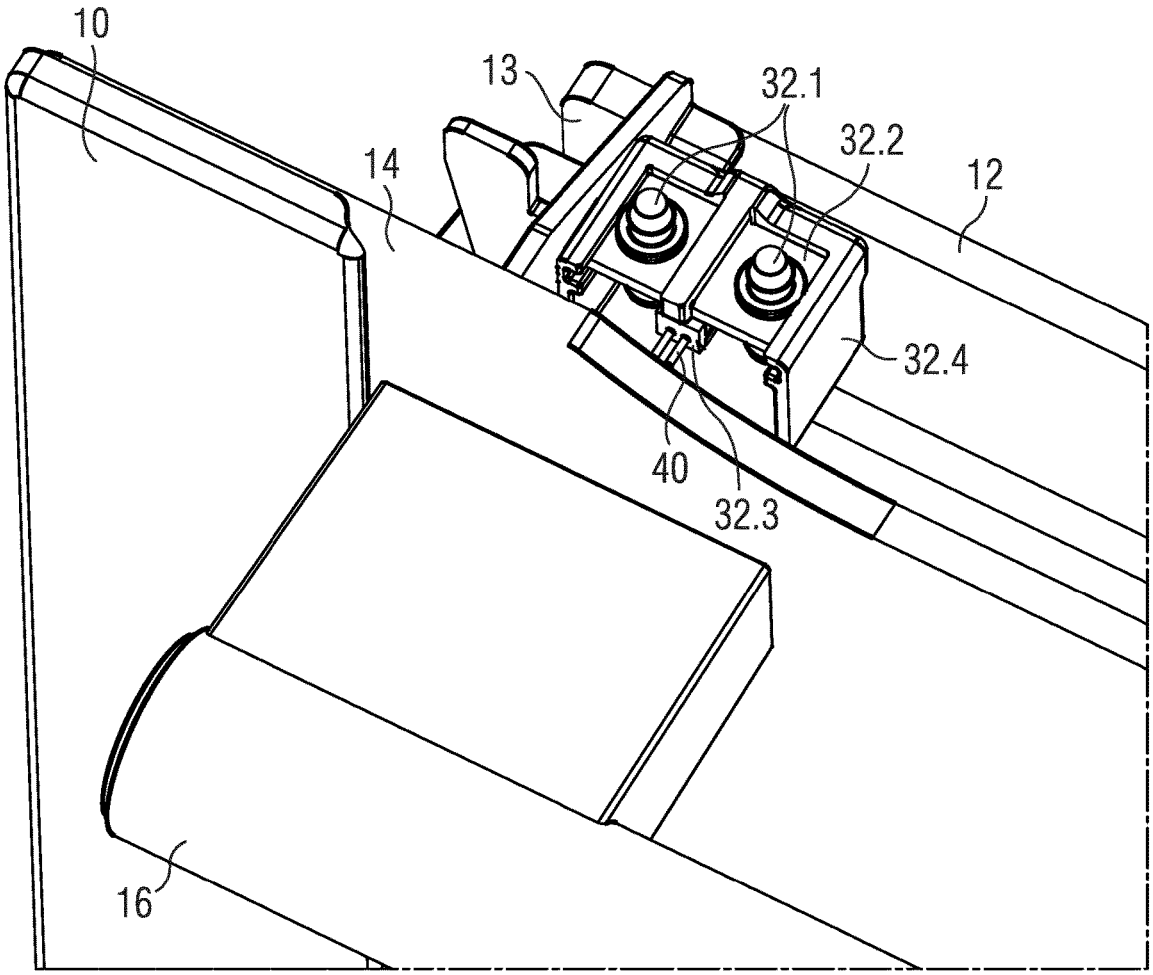
FIG. 7 shows an example schematic perspective view of second electrical coupling means after removing the removable door portion.

FIG. 7 shows a further embodiment of the fourth contact section 32. The fourth contact section 32 is directly connected, e.g. by means of soldering to SMD (surface mounted device) 32.2 where connectors 32.3 (e.g. plugs) or wiring can be directly soldered as well. According to another embodiment, plug-in type wiring can be directly plugged into the spring-loaded connector or directly connected by means of crimps etc.

An electrical component placed in/at the door 10 (e.g. LED light, camera, temperature sensor, control panel etc.) can be placed in the door 10 or on its front side (e.g. door handle 16) and can be connected by means of wiring 40 and, for example a connector 32.3 (plug) to above-mentioned fourth contact section 32. For example, the wiring may be fed through a hole 15 or a long-hole of the front glass pane 14. At the front side, said hole 15 may be covered by means of said door handle 16 or its adapter.

Figure 8:
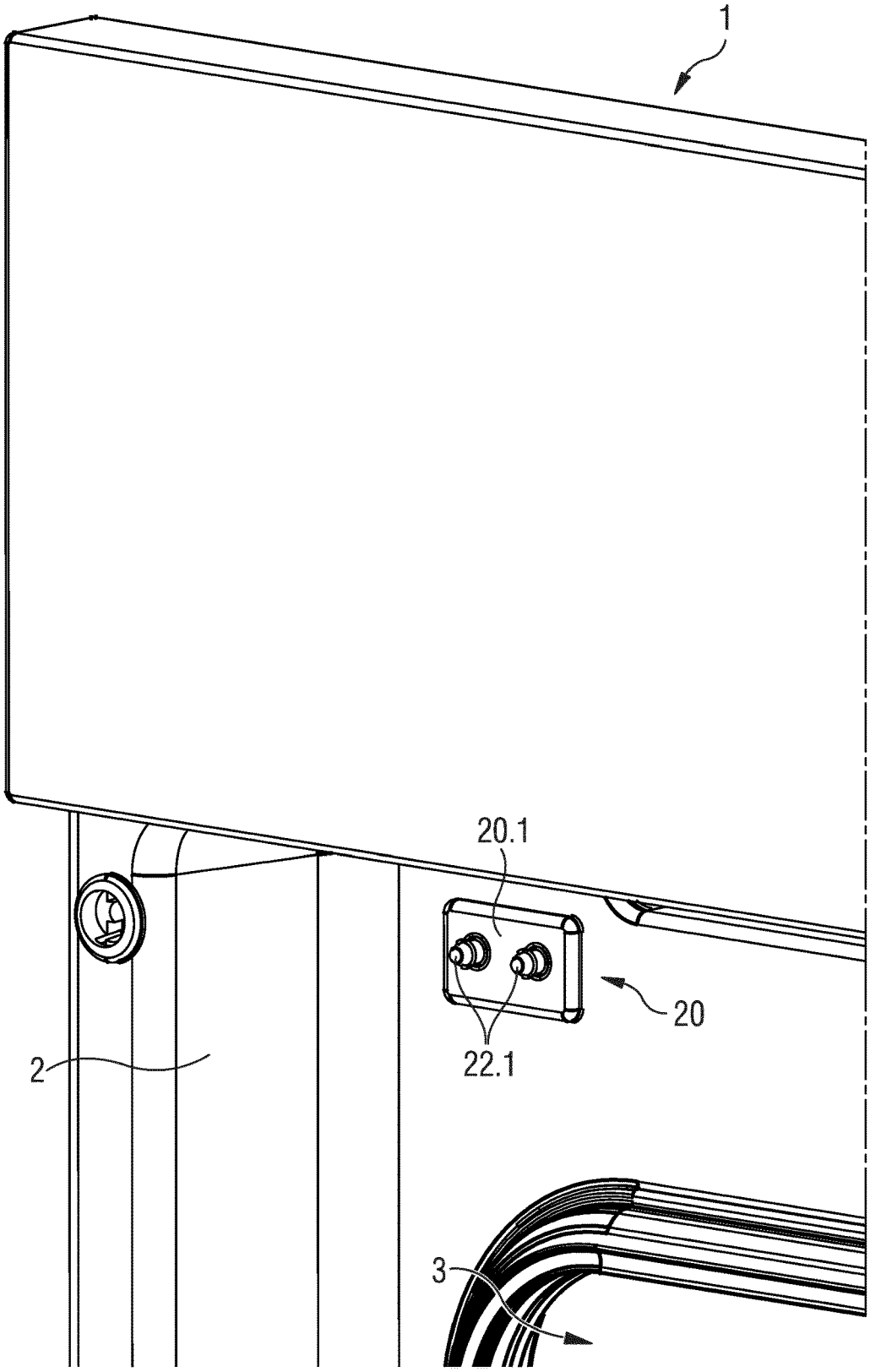
FIG. 8 shows an example schematic perspective front view of the second contact section.
Figure 9:
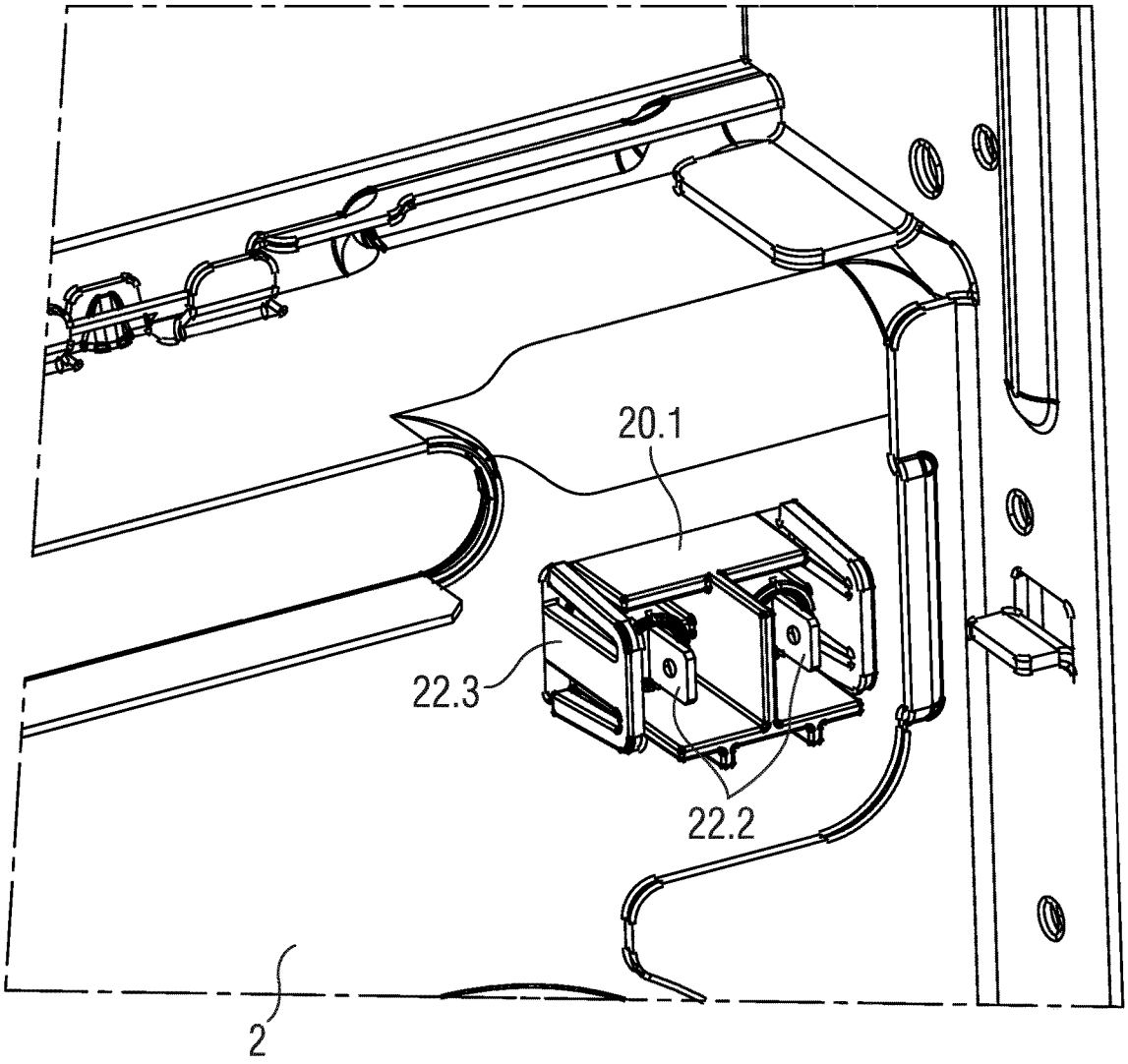
FIG. 9 shows an example schematic perspective rear view of the second contact section.

FIGS. 8 and 9 show in detail the second contact section 22 (FIG. 8 is a front-side view and FIG. 9 a rear-side view). The second contact section 22 comprises a pair of spring-loaded connectors, e.g. plungers 22.1. Said spring-loaded connectors are integrated in a housing 20.1, preferably a plastic housing. For example, the housing 20.1 may be made of Polybutylene terephthalate (PBT), liquid crystal polymer (LCP) or Polyphthalamide (PPA) including glass fibres (HTN). The housing may be adapted to be screwed into the chassis or may comprise clips 22.3 for realizing a snap-in mechanism. Similarly, also the second coupling means 30 may comprise a housing 32.4, in particular a plastic housing as described before (as shown in FIG. 7).

Each spring-loaded connector, specifically each plunger 22.1 may comprise a connector portion for electrically coupling the respective spring-loaded connector with an electrical wiring. Said connector portion may be provided at the rear side of the spring-loaded connector opposite to the contact surface facing the first contact section 21. According to the embodiment of FIG. 9, the connector portion is a crimp plug 22.2. According to other embodiments, the connector portion may be adapted to directly receive a free end of an electrical wire or the connector portion comprises a soldering area at which the wire is directly fixed by soldering.

Above, embodiments of an oven door according to the present invention as defined in the appended claims have been described. These should be seen as merely non-limiting examples. As understood by a skilled person, many modifications and alternative embodiments are possible within the scope of the invention.

LIST OF REFERENCE NUMERALS

1 household appliance
2 chassis
3 cavity
10 door
10.1 upper edge
10.2 lower edge
11 removable door portion
12 inner glass pane
13 door column
14 front glass pane
15 hole
16 door handle
20 first coupling means
20.1 housing
21 first contact section
21.1 contact sleeve
21.2 strip contact
22 second contact section
22.1 plunger
22.2 crimp plug
22.3 clip
30 second coupling means
31 third contact section
32 fourth contact section
32.1 spring-loaded connector
32.2 surface mounting device (SMD)
32.3 connector
32.4 plastic housing
40 wiring

The invention claimed is:

1. A household appliance comprising a chassis having a cavity therein and a door coupled to said chassis and being removable therefrom without tools, said door being configured to reversibly close said cavity; a first electrical component disposed in or on said door and a second electrical component disposed in or on said chassis; first coupling means for establishing an electrical connection between said first and second electrical components in a closed state of said door; said first coupling means comprising a first contact section on said door and a second contact section on said chassis, said first and second contact sections being releasably electrically coupled to one another when said door is in the closed state and being separated when said door is in an opened state; at least one of said first and second contact sections comprising a spring-loaded contact and/or a compression connector; said door comprising a door frame, a glass pane mounted in the door frame and a removable cap coupled to the door frame and being removable therefrom in order to disassemble the door without tools, wherein removal of said cap provides access to said glass pane for cleaning purposes; said first contact section being located on said removable cap at a location adjacent an upper edge of said door when the cap is assembled to the door frame; said door further comprising second coupling means for releasably electrically coupling said first electrical component to said first contact section when said cap is assembled to said door frame, said second coupling means comprising a third contact section on the removable cap that is electrically connected to said first contact section, and a fourth contact section on the door frame that is electrically connected to said first electrical component, said third and fourth contact sections being releasably electrically coupled to one another when said removable cap is properly assembled to said door frame, at least one of said third and fourth contact sections comprising a spring-loaded contact and/or a compression connector.

2. The household appliance according to claim 1, wherein the first electrical component comprises an electrical sensor or an electrical driven component and the second electrical component comprises a power board or a control unit of the household or kitchen appliance.

3. The household appliance according to claim 1, wherein the first and second contact sections and the third and fourth contact sections, respectively, form a pair of matching contact sections that comprise an electrical connector of compression type or sliding type.

4. The household appliance according to claim 1, wherein the first contact section is arranged close to one of two upper corners of the door.

5. The household appliance according to claim 1, wherein one of the first and second contact sections comprises a spring-loaded contact and/or a compression connector, and wherein the other of the first and second contact sections comprises a fixed electrically conductive contact area.

6. The household appliance according to claim 1, wherein the third and fourth contact sections are adapted to be brought into electrical contact by a sliding movement when the removable cap is assembled at the door.

7. The household appliance according to claim 1, wherein the glass plane is an inner glass pane that comprises an upper edge which can be covered by said removable cap in the mounted state of the inner glass pane.

8. The household appliance according to claim 7, wherein the removable cap is arranged adjacent to or on an upper edge of a front glass pane of the door.

9. The household appliance according to claim 8, comprising two door columns fixed at opposite sides in lateral regions of the front glass pane on a cavity-facing side thereof wherein the inner glass pane can be attached to the two door columns, wherein the removable cap is removably connected to the two door columns.

10. The household appliance according to claim 1, wherein the first and/or second coupling means comprise at least one plunger and at least one contact sleeve providing a cavity for receiving the plunger, wherein the plunger comprises a conical or tapered free end which is received in the cavity of the contact sleeve, and/or wherein the first and/or second coupling means comprise at least one plunger and at least one contact strip.

11. The household appliance according to claim 10, wherein the plunger is spring-loaded.

12. The household appliance according to claim 1, wherein at least one of the first, second, third and fourth contact sections is at least partially integrated in a plastic housing made of Polybutylene terephthalate (PBT), liquid crystal polymer (LCP) or Polyphthalamide (PPA) including glass fibres (HTN), wherein said housing is mounted at the chassis or the door.

13. The household appliance accord to claim 1, wherein the household appliance is an oven for preparing food.

14. The household appliance according to claim 1, wherein at least one of the first and second electric component is comprised in an upper region of the door or the chassis, wherein the door is pivotally connected to the chassis of the household or kitchen appliance about a horizontal axis at its lower edge region or about a vertical axis at one of its lateral edge regions.

15. The appliance according to claim 1, wherein contact surfaces of said first, second, third and fourth contact sections are plated with a high-conductivity coating selected from the group consisting of Au, Ag, Cu, Ni, Rh and Pt.

16. The appliance according to claim 1, wherein:

one of said first and second contact sections comprises a first tapered electrical contact and the other of said first and second contact sections comprises a first contact sleeve comprising a first cavity adapted to receive a free end of said first tapered electrical contact; and one of said third and fourth contact sections comprise a second tapered electrical contact and the other if said third and fourth contact sections comprises a second contact sleeve comprising a second cavity adapted to receive a free end of said second tapered electrical contact.

* * * * *